US007334921B1

(12) United States Patent
Simnor

(10) Patent No.: US 7,334,921 B1
(45) Date of Patent: Feb. 26, 2008

(54) FLEXIBLE LIGHTING SYSTEM

(76) Inventor: Richard Simnor, 31 Stonehenge Dr., Sewell, NJ (US) 08080

( * ) Notice: Subject to any disclaimer, the term of this patent is extended or adjusted under 35 U.S.C. 154(b) by 0 days.

(21) Appl. No.: 11/787,683

(22) Filed: Apr. 17, 2007

(51) Int. Cl.
*F21S 8/00* (2006.01)

(52) U.S. Cl. ..... 362/427; 362/249; 362/250; 362/372; 362/404; 362/418; 362/429

(58) Field of Classification Search ..... 362/249, 362/250, 372, 404, 418, 427, 429
See application file for complete search history.

(56) References Cited

U.S. PATENT DOCUMENTS

| | | | | |
|---|---|---|---|---|
| 3,251,023 | A | 5/1966 | Schick | |
| 3,404,268 | A | 10/1968 | Fowler | |
| 4,462,065 | A | 7/1984 | Rhodes | |
| 5,299,112 | A | 3/1994 | Nivette, Jr. et al. | |
| 5,513,081 | A | 4/1996 | Byers | |
| 5,833,358 | A * | 11/1998 | Patik | 362/391 |
| 5,957,568 | A | 9/1999 | Byers | |
| 5,984,489 | A | 11/1999 | Rubenstein | |
| 6,854,871 | B1 | 2/2005 | Morton | |
| 2002/0060910 | A1 * | 5/2002 | Knight | 362/250 |

* cited by examiner

*Primary Examiner*—Stephen F. Husar
*Assistant Examiner*—Meghan K. Dunwiddie
(74) *Attorney, Agent, or Firm*—Norman E. Lehrer

(57) ABSTRACT

A lighting system that includes an elongated strip of flexible, shape-retaining material and a plurality of light sockets mounted on the strip. Each of the light sockets is electrically connected together and may be adjusted individually so that light may be directed in a variety of angles and directions. The flexible material is malleable. All of the wiring is located within and extends along the strip of material with a plug extending outwardly from an end of the strip. The strip may be mounted and secured about or to an indoor or outdoor structure.

2 Claims, 3 Drawing Sheets

FLEXIBLE LIGHTING SYSTEM

BACKGROUND OF THE INVENTION

The present invention is directed toward a lighting system and more particularly, towards a lighting system that includes a plurality of adjustable light sockets secured to a flexible strip of material.

Decorative lighting systems used indoors and outdoors are well known. For example, a plurality of lights strung on a wire can be used to decorate indoor real or artificial Christmas trees as well as year round on live trees outdoors. Also, stringed lights have been used to illuminate poles, houses, buildings, driveways, and the like. Spotlights have also been used to illuminate trees, landscaping, or outdoor decorative structures.

Each of the situations described above, however, typically requires a specific type of system. A lighting system that is versatile enough to accommodate most, if not all, of the situations described above would be economical and more efficient than using a variety of different types of systems for particular applications.

For example, U.S. Pat. No. 3,404,268 to Fowler discloses a tubular strip having a plurality of light sockets mounted thereon for receiving light bulbs. This lighting system does provide versatility in that the system may be used in various types of settings. However, it does not allow the individual light sockets to be adjusted so as to provide even more versatility.

U.S. Pat. No. 4,462,065 to Rhodes discloses an elongated tubular member with a plurality of lights mounted thereon. The lights extend through the branches of a tree and are used to decorate the tree. This device, however, does not appear to be easily usable on other types of structures.

Therefore, a need exists for a lighting system that may be used indoors or outdoors and conforms to almost any surface as well as provides the ability of the individual lights to be adjustable.

SUMMARY OF THE INVENTION

The present invention is designed to overcome the deficiencies of the prior art discussed above. It is an object of the present invention to provide a lighting system that may be used in a variety of situations.

It is another object of the present invention to provide a lighting system where each light socket may be adjusted individually as needed so that light may be directed in a variety of angles.

In accordance with the illustrative embodiments demonstrating features and advantages of the present invention, there is provided a lighting system that includes an elongated, generally flat, strip of flexible, shape-retaining material and a plurality of light sockets mounted on the strip. Each of the light sockets is electrically connected together and may be adjusted individually so that light may be directed in a variety of angles and directions. The flexible material is malleable. All of the wiring is located within and extends along the strip of material with a plug extending outwardly from an end of the strip. The strip may be mounted and secured about or to an indoor or outdoor structure.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
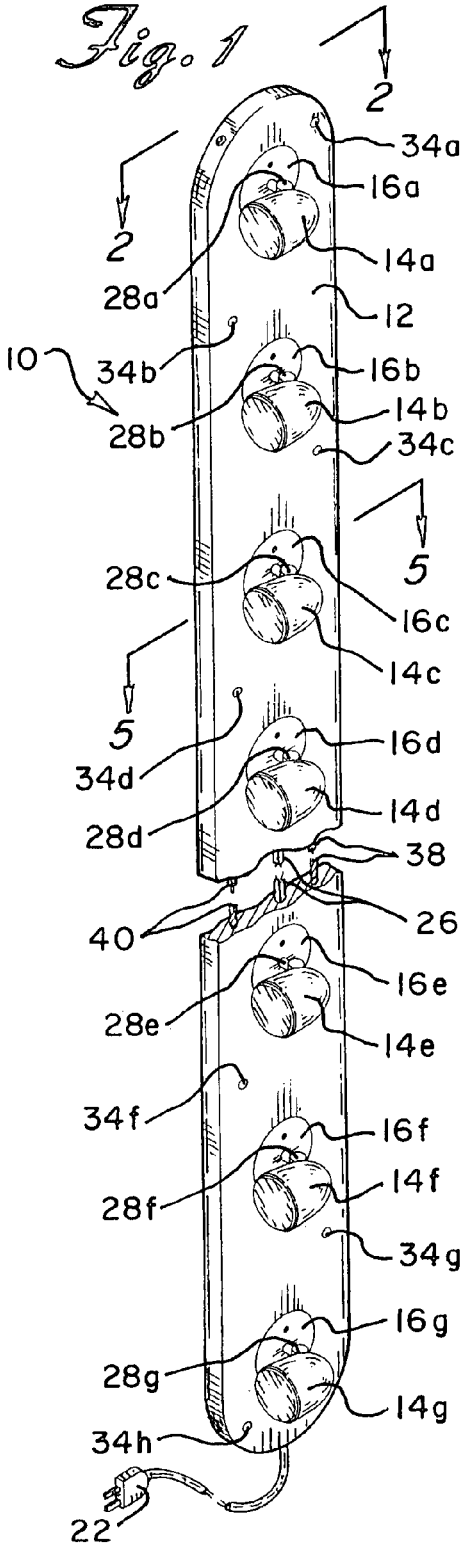
FIG. 1 is a front perspective of the lighting system of the present invention.

Referring now to the drawings in detail wherein like reference numerals have been used throughout the various figures to designate like elements, there is shown in FIG. 1 a lighting system constructed in accordance with the principles of the present invention and designated generally as 10.

The lighting system of the present invention essentially includes an elongated, generally flat, strip 12 of a flexible, preferably shape-retaining material and a plurality of light sockets 14*a*-14*g*, for example, mounted on the strip 12. The flexible material is preferably malleable and may be made from a plastic, rubber, or similar type of material. The material may also be weather-resistant. The strip 12 may be of substantially any width and length.

Figure 4:
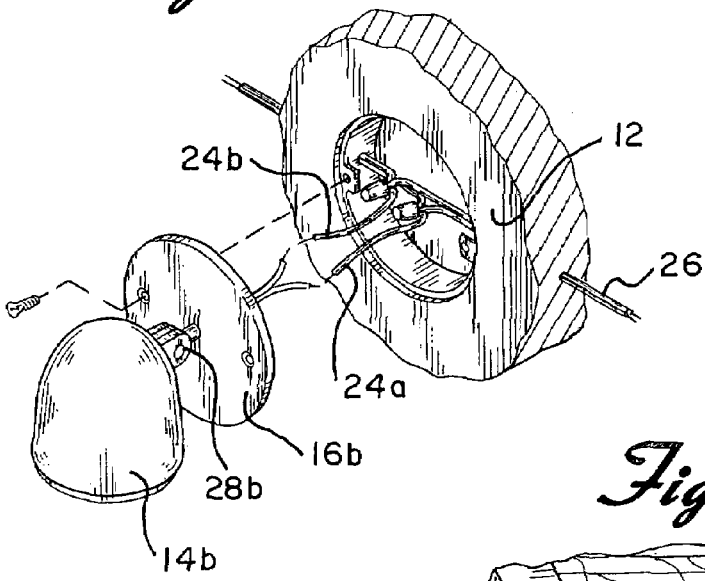
FIG. 4 is an exploded view of one of the lights of the light system of the present invention.
Figure 8:
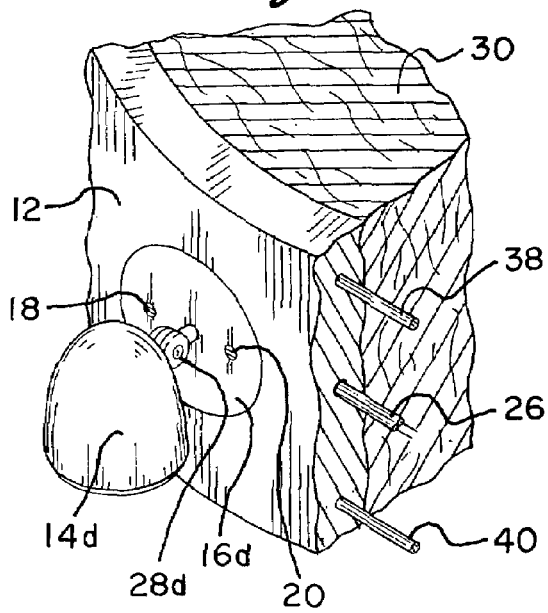
FIG. 8 is a cross-sectional view of the lighting system taken through line 8-8 of FIG. 6.
Figure 5:
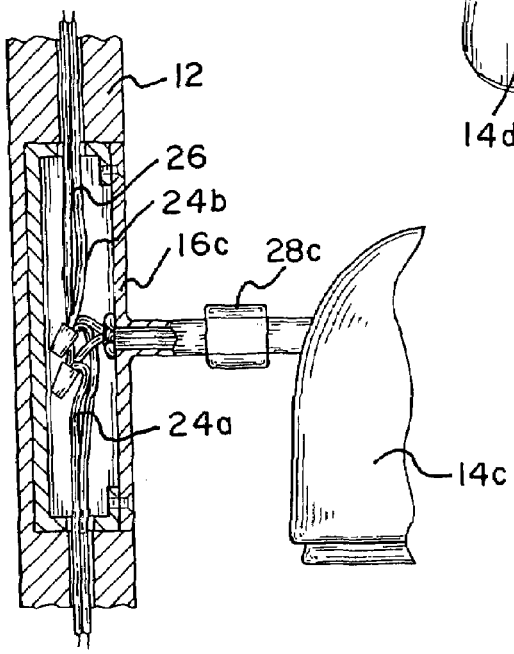
FIG. 5 is a cross-sectional view of the lighting system taken through line 5-5 of FIG. 1.

Each light socket 14*a*-14*g* is mounted to a base plate 16*a*-16*g*, respectively. (See FIG. 4.) Each plate is mounted to the strip 12 via screws 18 and 20, for example. (See FIG. 8.) All of the wiring is located within and extends along the strip of material. (See FIG. 5.) A plug 22, to be inserted into an outlet, extends outwardly from an end of the strip 12. The light sockets 14*a*-14*g* are electrically connected in parallel to each other via wires, such as wires 24*a* and 24*b*, and power cord 26.

Figure 2:
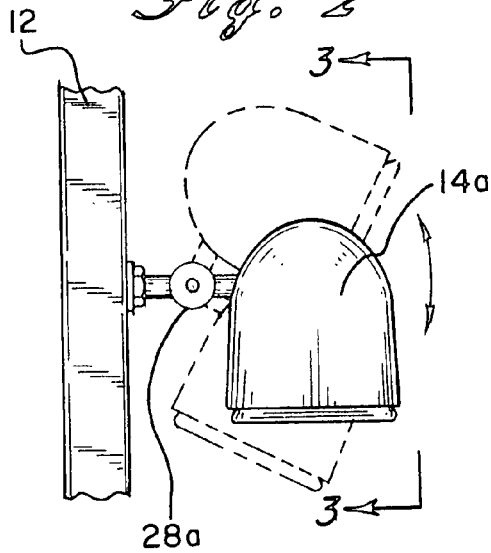
FIG. 2 is a cross-sectional view of the lighting system taken through line 2-2 of FIG. 1.
Figure 3:
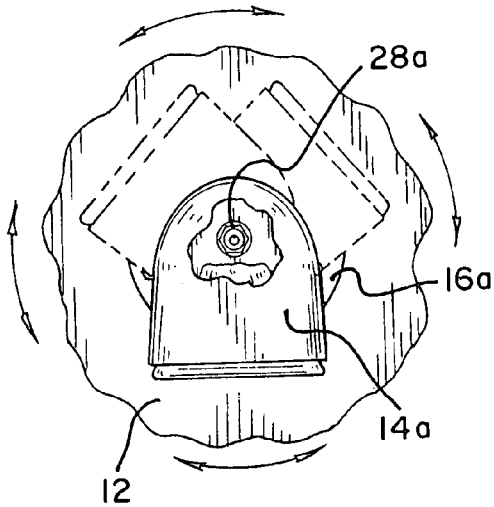
FIG. 3 is a cross-sectional view of the lighting system taken through line 3-3 of FIG. 2.

Preferably, each light socket 14*a*-14*g* is pivotable about a hinge 28*a*-28*g*, respectively, so that each socket may be adjusted individually as desired. (See FIGS. 2 and 3.) In this manner, light may be directed in a variety of angles and directions, such as upwardly, downwardly, to the right, or to the left.

Figure 6:
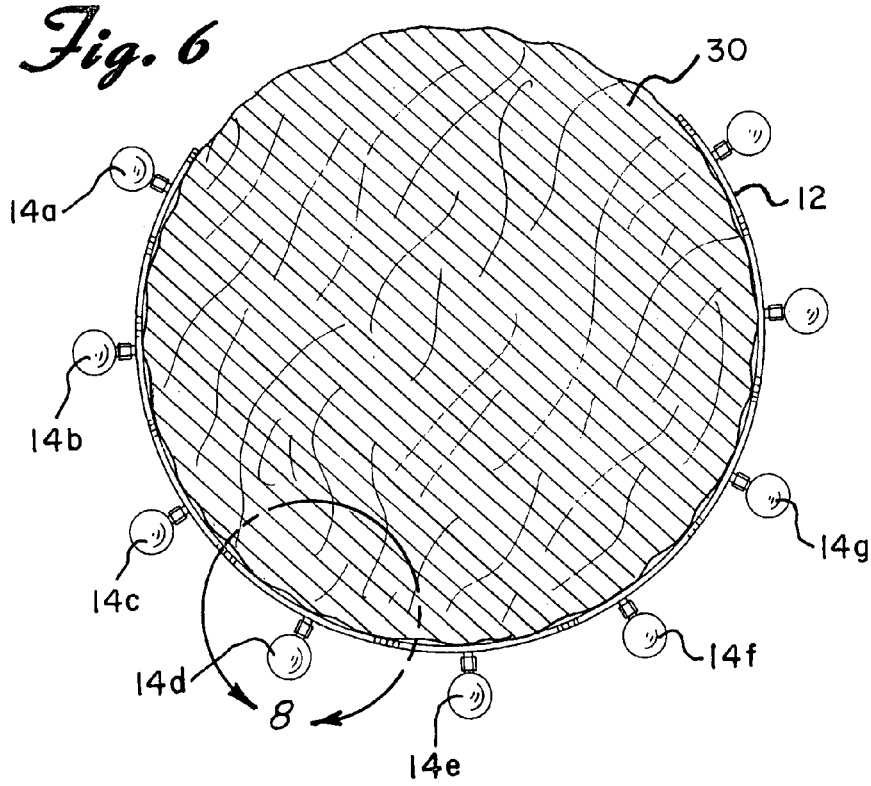
FIG. 6 illustrates the lighting system of the present invention being applied to a generally circular surface.
Figure 7:
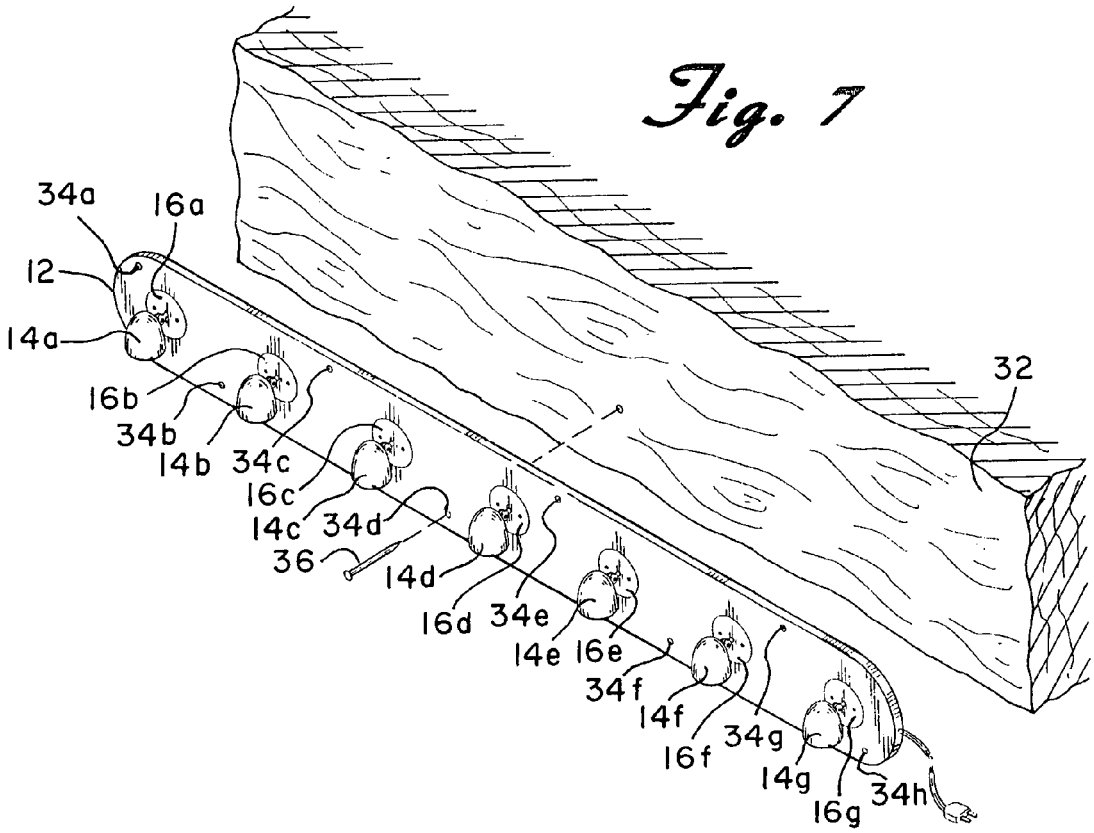
FIG. 7 illustrates the light system of the present invention being applied to a surface.

The present invention may be used in a variety of situations and applications. For example, FIG. 6 illustrates the light system of the present invention mounted about a generally circular structure 30, such as the trunk of a tree. FIG. 7 illustrates the light system of the present invention being mounted to a panel, board, or similarly shaped elongated, generally flat structure 32. Means for securing the flexible strip to a surface may include a plurality of holes or openings 34*a*-34*h*, for example, through which a nail or screw 36 may be inserted and secured to the underlying structure.

Because of the nature of the material of the strip 12, it will retain the shape of the structure to which it is mounted. However, the strip 12 also includes a plurality of malleable, metallic rods 38 and 40, for example, which extend through the strip and add to the strength and shape-retaining nature of the strip 12. (See FIG. 8.) As a result, the lighting system 12 can be wrapped around a tree, for example, and will remain in place without the need for nails or screws or the like.

The present invention may be embodied in other specific forms without departing from the spirit or essential attributes thereof and accordingly, reference should be made to the appended claims rather than to the foregoing specification as indicating the scope of the invention.

I claim:

1. A flexible lighting system comprising:

an elongated, generally flat, malleable strip of flexible, shape-retaining material, said strip having a length;

a plurality of light sockets mounted on said strip; and wire connections extending along and within the length of said flexible strip wherein each of said light sockets is electrically connected together and may be adjusted individually thereby allowing light to be directed in a variety of directions.

2. The flexible lighting system of claim 1 wherein each of said light sockets includes a hinge about which each of said sockets pivots, respectively.

* * * * *